United States Patent [19]

Szpur

[11] 4,021,660

[45] May 3, 1977

[54] LIGHT FIXTURE

[75] Inventor: Roman Szpur, Dayton, Ohio

[73] Assignee: Panabeam Corporation, Dayton, Ohio

[22] Filed: Sept. 30, 1975

[21] Appl. No.: 618,136

[52] U.S. Cl. ..... 240/41.55; 240/47; 240/90

[51] Int. Cl.[2] ..... F21V 17/00; F21V 29/00; F21V 15/04

[58] Field of Search ..... 240/41.35 R, 41.35 E, 240/41.55, 47, 26, 90

[56] References Cited

UNITED STATES PATENTS

| | | | |
|---|---|---|---|
| 2,413,381 | 12/1946 | Rylsky | 240/90 X |
| 2,907,870 | 10/1959 | Calmes | 240/47 X |
| 3,021,422 | 2/1962 | Ogier et al. | 240/47 X |
| 3,097,903 | 7/1963 | Moore | 240/47 X |
| 3,267,277 | 8/1966 | McLamb | 240/26 |
| 3,459,934 | 8/1969 | Moore | 240/47 |

*Primary Examiner*—George H. Miller, Jr.
*Attorney, Agent, or Firm*—Jacox & Meckstroth

[57] ABSTRACT

A rectangular reflector sheet of relatively stiff aluminum is curved into the general shape of an elongated parabola and is inserted into a cylindrical transparent glass tube so that the edge portions of the sheet press outwardly against the tube. A set of end closure caps or members are clamped against the ends of the tube by a pair of tie bolts which extend axially between the reflector sheet and the inner surface of the tube. Each of the end closure members is provided with an annular groove which receives an annular resilient gasket and the corresponding end of the tube to form a fluid-tight seal between the tube and the closure member. One of the end closure members has an eccentrically located hollow hub portion which supports a socket for receiving the socket end of an elongated lamp element extending along the offset focal axis of the curved reflector sheet. The other end closure member has a similar eccentric hub portion which supports a member for conducting heat from the lamp element as well as for supporting the opposite end of the lamp element. Both of the end closure members also support corresponding end reflector panels which project cantileveredly into the tube, and the closure members are provided with outwardly projecting ribs for radiating heat from the light fixture.

17 Claims, 4 Drawing Figures

LIGHT FIXTURE

BACKGROUND OF THE INVENTION

In the art of commercial and industrial lighting fixtures such as disclosed, for example, in U.S. Pat. Nos. 3,246,135, 3,254,205, 3,609,337 and 3,610,915, it is desirable to provide for tightly sealing the fixture housing which receives the lamp element and the reflectors in order to avoid the seepage of dust, dirt and mositure into the housing and onto the lamp element and reflectors. As shown in above U.S. Pat. Nos. 3,246,135 and 3,609,337, one form of seal is provided by positioning a resilient gasket between the frame-like surface on the cast metal housing and the covering glass lens element which is retained by a surrounding cast metal frame. Due to the cast construction of the metal housings and frames and the difficulty of obtaining precisely parallel surfaces between each housing and frame, it is frequently difficult to obtain a positive, fluid-tight and dependable seal which prevents the seepage of dust and mositure into the lamp and reflector chamber.

It has also been found desirable to provide a high intensity commerical and industrial light fixture with means for conveniently changing the projected angle of the light from the fixture in order to change the area of illumination or to concentrate the projected light in a specified area. Furthermore, it has been found desirable to provide for conveniently constructing the light fixture in different sizes for different intensities of illumination and thus be able to accommodate electric lamp elements of different sizes or lengths.

It is apparent after carefully reviewing the disclosures of the above patents and of other prior art lighting fixtures such as disclosed in U.S. Pat. Nos. 1,873,392, 2,849,598 and 3,679,886, that none of the light fixtures which have been either constructed or proposed, provide all of the desirable features mentioned above.

SUMMARY OF THE INVENTION

The present invention is directed to an improved electrical light fixture which is ideally suited for use in a environment where the fixture is exposed to high moisture and/or a high concentration of dust particles, and which is simple and inexpensive in construction in addition to having high rigidity and durability. The light fixture of the invention also provides for conveniently changing the angle through which light is projected and thereby provides for conveniently changing the area of illumination. The light fixture further provides for thermal expansion and contraction of the assembled components in response to energizing and deenergizing the electric lamp element, and is adapted to be easily constructed in different sizes for accommodating lamp elements of different wattage such as, for example, a lamp element of 400 watts and one of 1,000 watts.

In accordance with the illustrated embodiment, the above desirable features and advantages are generally provided by a lamp fixture which includes an elongated cylindrical tube of high strength glass. A flat rectangular reflector sheet of relatively stiff metal is curved into the general shape of a parabola and is inserted into the tube so that opposite edge portions and an intermediate center portion are urged outwardly against the inner surface of the tube. A set of end caps or closure members are provided with annular grooves and gaskets for receiving the opposite end portions of the glass tube, and the closure members are clamped against the ends of the tube by a pair of the rods which extend axially between the inner surface of the tube and the reflector sheet.

The closure members have corresponding eccentrically located and outwardly projecting hollow hub portions. One of the hub portions receives a socket for supporting the threaded end of an electric lamp element, and the hub portion of the other end closure member supports a spring biased member which engages the opposite end of the lamp element for conducting heat from the lamp element and for aiding in its support. The closure members also support corresponding end reflector panels which project into the glass tube, and spaced heat radiating ribs are formed as integral parts of the end closure members.

Other features and advantages of the invention will be apparent from the following description, the accompanying drawings and the appended claims.

DESCRIPTION OF THE PREFERRED EMBODIMENT

Figure 1:
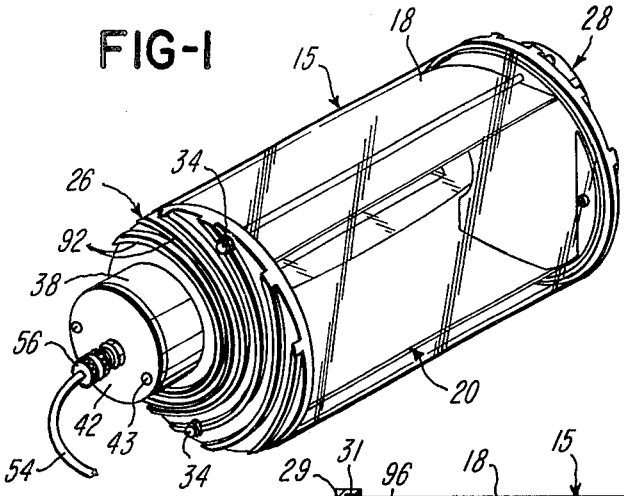
FIG. 1 is a perspective view of an electric light fixture constructed in accordance with the invention.
Figure 3:
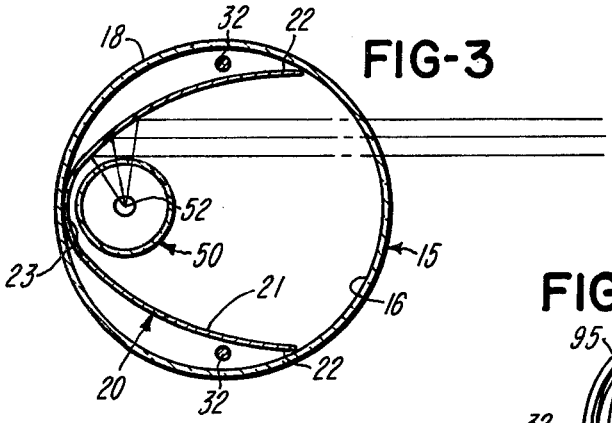
FIG. 3 is a radial section taken generally on the line 3—3 of FIG. 2.
Figure 4:
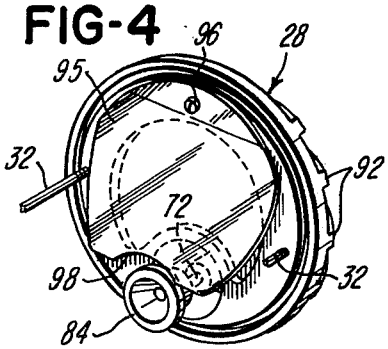
FIG. 4 is a perspective view of the exploded end closure member shown in FIG. 2.

The light fixture illustrated in FIG. 1 includes an elongated cylindrical tube 15 of high strength or tempered transparent glass and which has a smooth cylindrical inner surface 16 and a smooth cylindrical outer surface 18. A reflector member or sheet 20 consists of a rectangular panel or sheet of aluminum having a highly polished reflective surface 21. Prior to being inserted into the tube 15, the relatively stiff reflector panel or sheet 20 is stored as a flat sheet. When a light fixture is assembled, the sheet is trimmed to a predetermined length according to the angle of light projection and the desired area of illumination. The reflector sheet is then manually bent or curved into a generally parabolic configuration (FIG. 3) and is inserted into the tube 15 so that the opposite edge or end portions 22 and an intermediate center portion 23 of the sheet are urged outwardly against the inner surface 16 of the tube 15 due to the inherent spring characteristic of the relatively stiff alumminum reflector sheet 20. This spring characteristic assures that the reflector sheet 20 remains in position, as illustrated in FIG. 3, but permits the edge portions 22 of the sheet to shift slightly relative to the inner surface 16 of the tube 15 in response to thermal expansion and contraction of the reflector sheet as its temperature changes.

Figure 2:
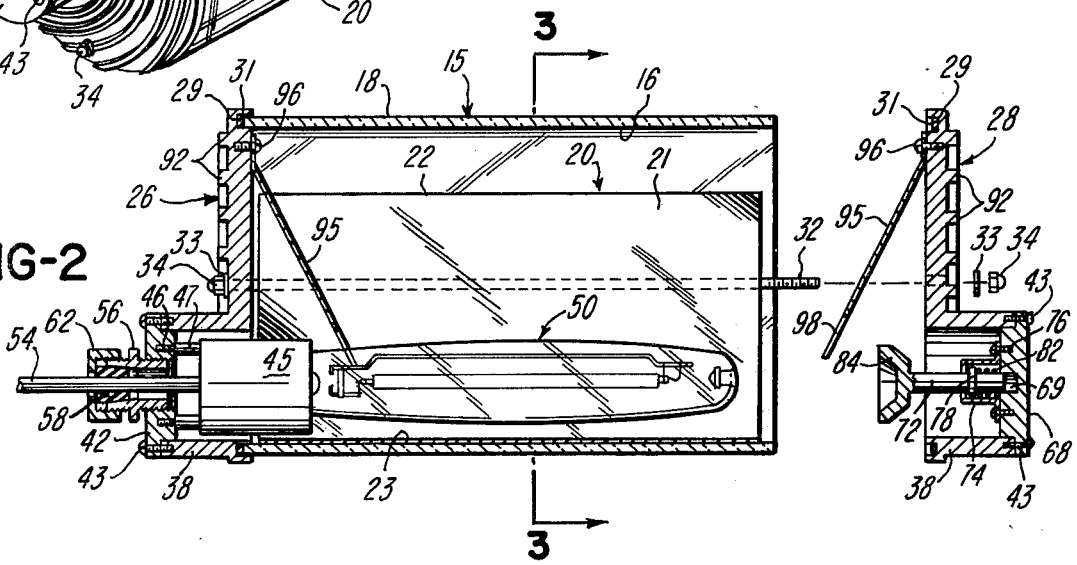
FIG. 2 is an axial section of the light fixture shown in FIG. 1 and with an end closure member shown in an exploded position.

As shown in FIG. 2, the axial length of the reflector sheet 20 is slightly less than the axial length of the tube 15, and the opposite end portions of the tube 15 receive a corresponding set of end closure members 26 and 28 which are preferably cast from aluminum. Each of the end closure members 26 and 28 includes an annular groove 29 which receives the corresponding end portion of the tube 15 and which confines an annular resilient rubber-like gasket 31 of engaging the corresponding end surface of the tube 15.

A pair of parallel spaced tie bolts 32 extend axially within the tube 15 between the reflector sheet 20 and the inner surface 16 of the tube and are disposed in diametrically opposite positions within the tube 15. The opposite end portions of each tie rod 32 are threaded and extend through corresponding holes within the end closure members 26 and 28, and each end portion receives a washer 33 and a cap-nut 34. When the nuts 34 are tightened, the end closure members 26 and 28 are drawn towards the ends of the tube 15 in order to compress and deform the gaskets 31 and to form a fluid-tight seal between the tube 15 and each end closure member.

Each of the end closure members 26 and 28 includes an outwardly projecting hollow hub portion 38 which is offset or positioned eccentrically relative to the axis of the tube 15. The tubular hub portion 38 of the end closure member 26 has an outer end which is closed by a circular plug-like end wall 42 secured by a set of screws 43.

A porcelain lamp socket 45 is supported within the tubular portion 38 of the end closure member 26 by a set of screws 46 which extend through corresponding spacer tubes 47. The lamp socket 45 receives the threaded base of an elongated lamp element 50 which may be of the sodium high vapor pressure type such as the lamp element marketed by the General Electric Company under the trademark Lucalox. The lamp element 50 may also be of other types such as quartz-iodine or xenon lamp.

As shown in FIG. 3, the axis of the lamp element 50 is substantially coincedent or common with the axis of the tubular hub portions 38 of the end closure members 26 and 28 and is also substantially coincedent or common with the focal axis 52 of the curved reflector sheet 20. Electrical power is supplied through the lamp socket 45 to the lamp element 50 by a power cord 54 which is connected to a suitable transformer or ballast (not shown). The cord 54 extends through a tubular fitting 56 threaded into a center opening within the end wall 42 of the tubular hub portion 38. The fitting 56 has a frusto-conical internal end surface which receives a mating surface on a resilient annular sealing member 58. The sealing member 58 is retained by an annular cap 62 which is threadably connected to the fitting 56. Thus when the cap 62 is tightened, the sealing member 58 is compressed firmly between the outer surface of the power supply cord 54 and the inner surface of the fitting 56 to form a positive fluid-tight seal.

The tubular or hollow hub portion 38 of the opposite enclosure cap or member 28 includes a removable outer end wall 68 which is also secured by a set of screws 43. The end wall 68 includes a centrally located blind cylindrical bore 69 which slidably receives one end portion of a cylindrical aluminum rod 72. An intermediate portion of the rod 72 is supported by a cup-shaped sheet material housing 74 having a bottom flange portion secured to the end wall 68 by a set of screws 76. The housing 74 surrounds an outwardly projecting circumferential flange 78 formed on the rod 72 and encloses a compression coil spring 82 which extends between the flange 78 and the inner surface of wall 68.

The outer end portion of the rod 72 supports an aluminum cup member 84 which is adapted to engage the outer corresponding end portion of the lamp element 50 when the end closure member 28 is mounted on the corresponding end of the tube 15. The spring loaded cup member 84 serves not only to position and support the outer end portion of the lamp element 50 but also cooperates to conduct heat from the lamp element 50 through the rod 72 and the housing 74 to the end wall 68 of the hub portion 38. The cup member 84 may be lined with a thin layer of asbestos materials to provide a cushion support for the outer end of the lamp element 50.

As shown in FIGS. 1 and 2, both of the end closure members 26 and 28 are provided with a series of outwardly projecting arcuate fins or ribs 92 which extend concentrically with the corresponding hollow hub portion 38. The integral ribs 92 of the aluminum end closure members 26 and 28 cooperate to aid in dissipating heat which is generated when the lamp element 50 is energized.

The end closure members 26 and 28 also support a corresponding set or pair of end reflector sheets or members 95 which are formed from the same relatively stiff aluminum sheet material used to form the reflector sheet 20. Each of the end reflector members 95 includes an edge portion which is secured to the corresponding end closure member by a screw 96. The remaining or major portion of the reflector member projects in a cantilevered manner from the corresponding end closure member into the corresponding end portion of the tube 15 and curved reflector sheet 20. The inner end portion of each reflector sheet 95 has an arcuate recess 98 for receiving the corresponding end portion of the lamp element 50.

From the drawing and the above description, it is apparent that a light fixture constructed in accordance with the present invention, provides desirable features and advantages. For example, the light fixture is not only durable in construction but is also simple and economical to construct. As mentioned above, the reflector sheet 20 is adapted to be stored as a flat rectangular sheet and is simply trimmed along one edge according to the desired angle of light projection. Thus as illustrated in FIG. 3, the projected light rays are substantially parallel. However, by simply trimming off an edge portion of the flat sheet, when the sheet is curved and inserted into the glass tube 15, it is apparent that the end portions 22 of the sheet will move further outwardly within the tube to provide for a wider angle of reflection and diverging light rays. This flexibility permits one light fixture to be quickly and inexpensively modified to change the area of illumination.

The light fixture is also adapted to be conveniently constructed to accommodate lamp elements 50 of different wattage and corresponding length. Thus when it is desired to use a longer lamp element having a greater wattage, it is only necessary to increase the length of the tube 15 and the corresponding length of the tie rods 32. This flexibility is highly desirable in order to accommodate different types of lamp elements.

The generally cylindrical configuration of the glass tube 15 is also desirable in that it is self-cleaning when exposed to wind and rain. However, while a clear transparent glass tube 15 is illustrated in the drawing, it is apparent that the tube may be provided with a filter. The glass tube may also be provided with outwardly projecting integral ribs or the tube may be partially surrounded with a metal sleeve having outwardly projecting integral ribs for dissipating heat, for example, when lamp elements of high wattage are used within the tube. It is also apparent that either or both of the tubular hub portions 38 of the end closure members 26 and 28 may be provided with an outer end all coupled by a quick release fastener, such as a bayonet type connection, to facilitate quick removal and interchangement of the lamp element 50.

While the form of light fixture herein described constitutes a preferred embodiment of the invention, it is to be understood that the invention is not limited to this precise form of fixture, and that changes may be made therein without departing from the scope and spirit of the invention as defined in the appended claims.

I claim:

1. A method of producing a light fixture adapted for use in an environment of high moisture and/or high dust particles, comprising the steps of forming a primary reflector element having a generally U-shaped inner reflecting surface, inserting said primary reflector element axially into a light transmitting rigid tube having a center axis, securing a set of end closure members to opposite end portions of said tube, and supporting with one of said end closure members an elongated lamp element with its axis spaced eccentrically between the center axis of said tube and said inner reflecting surface of said reflector element.

2. A method as defined in claim 1 and including the steps of forming at least one end reflector element, mounting said end reflector element on one of said end closure members, and positioning said end reflector element with a portion projecting axially inwardly from said one end closure member into said tube.

3. A method as defined in claim 1 including the steps of forming an outwardly projecting hollow support hub on at least one of said end closure eccentrically of said center axis and positioning a lamp socket member within said hub for supporting said lamp element.

4. An improved light fixture adapted for use in an environment of high moisture and/or high dust particles, comprising a generally cylindrical tube of light transmitting material and having a center axis, said tube including opposite end portions and having generally cylindrical inner and outer surfaces, a set of end closure members mounted on corresponding said end portions of said tube, means for positively securing said end closure members to the corresponding said end portions of said tube, reflector means within said tube and forming a reflecting surface having generally a focal axis spaced between said center axis of said tube and said inner surface of said tube, and means on one of said end closure members for supporting an elongated lamp element with an axis spaced between said center axis of said tube and said reflecting surface and generally on said focal axis of said reflecting surface.

5. A light fixture as defined in claim 4 wherein said reflector means comprises a curved generally rectangular sheet of relatively stiff metal having an inherent spring characteristic causing opposite edge portions of said reflector sheet to be urged outwardly toward said inner surface of said tube.

6. A light fixture as defined in claim 4 and including at least one end reflector panel of sheet material, means for securing an edge portion of said reflector panel to one of said end closure members, and the remaining portion of said reflector panel projects outwardly in a cantilevered manner from said one end closure member and into said tube.

7. A light fixture as defined in claim 4 wherein said means for securing said end closure members to said corresponding end portions of said tube comprise a set of parallel spaced tie rods extending axially between said reflector means and said inner surface of said tube, and means connected to said tie rods for drawing said end closure members firmly against the corresponding said end portions of said tube.

8. A light fixture as defined in claim 4 wherein said lamp element includes an outer curved end surface positioned generally adjacent one of said end closure members, cup means for engaging said outer end surface of said lamp element, and a spring biased metal member mounted on said one end closure member and supporting said cup means for conducting heat from said lamp element to said one end closure member.

9. A light fixture as defined in claim 4 wherein at least one of said end closure members includes an outwardly projecting hollow support hub having an axis disposed eccentrically to said axis of said tube, and means within said support hub for supporting one end of said lamp element.

10. A light fixture as defined in claim 9 wherein said hub portion of said one end closure member includes a removable outer end wall to provide for convenient access to said lamp element, and said hub portion defines an opening of sufficient size for removing said lamp element axially from said tube through said opening.

11. A light fixture as defined in claim 9 wherein each of said end closure members includes a plurality of outwardly projecting heat radiating ribs spaced generally concentric with said hub to provide for transferring heat from said light fixture to the surrounding atmosphere.

12. An improved light fixture adapted for use in an environment of high moisture and/or high dust particles, comprising a generally cylindrical glass tube having a center axis, said tube including opposite end portions and having generally cylindrcial inner and outer surfaces, a set of end closure members mounted on corresponding said end portions of said tube, means for positively securing said closure members to the corresponding said end portions of said tube and for forming a fluid-tight seal therebetween, a flexible curved reflector sheet disposed within said tube and having generally parallel opposite edge portions, said inner surface of said glass tube supporting said edge portions of said reflector sheet to form a generally parabolic cross-sectional configuration with a focal axis spaced between said center axis of said tube and said inner surface of said tube, a set of end reflector panels supported by the corresponding said end closure members and projecting into said tube, and means on one of said end closure members for supporting an elongated lamp element spaced between said center axis of said tube and said reflector sheet generally on said focal axis of said reflector sheet.

13. A light fixture as defined in claim 12 wherein said reflector sheet comprises a curved generally rectangular sheet of relatively stiff metal having an inherent spring characteristic causing said opposite edge portions of said reflector sheet to be urged outwardly toward said inner surface of said glass tube.

14. An improved light fixture adapted for use in an environment of high moisture and/or high dust particles, comprising a generally cylindrical tube of light transmitting material and having a center axis, said tube including opposite end portions and having generally cylindrical inner and outer surfaces, a set of end closure members mounted on corresponding said end portions of said tube, means for positively securing said closure members to the corresponding said end portions of said tube, a reflector sheet disposed within said tube and having generally parallel opposite edge portions, said inner surface of said tube supporting said edge portions of said reflector sheet and confining said sheet to form a generally parabolic cross-sectional configuration with a focal axis spaced between said center axis of said tube and said inner surface of said tube, each of said end closure members including a hub portion disposed eccentrically to said center axis of said tube, and socket member positioned within one of said hub portions for supporting an elongated lamp adjacent said focal axis of said reflector sheet.

15. An improved light fixture adapted for use in an environment of high moisture and/or high dust particles, comprising an elongated transparent tube having opposite end portions and a center axis, a set of end closure members mounted on corresponding said end portions of said tube, means for positively securing said end closure members to the corresponding said end portions of said tube, a reflector element disposed with said tube and having a generally U-shaped inner reflector surface with a focal axis spaced between said center axis of said tube and said reflecting surface, and means located on one of said end closure members eccentrically of said center axis for supporting an elongated lamp element with an axis spaced between said center axis of said tube and said reflecting surface.

16. A light fixture as defined in claim 15 and including at least one end reflector element, means mounting said one end reflector element, on one of said end closure members, and said end reflector element projects inwardly from said one end closure member into said tube and has an inner reflecting surface disposed at an angle with respect to said center axis of said tube.

17. A light fixture as defined in claim 15 including a spring biased metal plunger mounted on the other said end closure member, and metal cup means mounted on said plunger for supporting said lamp element and for conducting heat from said lamp element to said end closure member.

* * * * *

UNITED STATES PATENT OFFICE

CERTIFICATE OF CORRECTION

Patent No. 4,021,660 Dated May 3, 1977

Inventor(s) Roman Szpur

It is certified that error appears in the above-identified patent and that said Letters Patent are hereby corrected as shown below:

Column 2, line 67, "of" should be -- for -- .

Column 3, line 57, "material" should be -- metal -- .

Column 4, line 6, "materials" should be -- material -- .

Column 5, line 1, "all" should be -- wall -- .

Claim 3, Column 5, line 32, after "closure" insert -- members -- .

Claim 14, Column 7, line 11, after "and" insert -- a -- .

Claim 14, Column 7, line 12, after "lamp" insert -- element -- .

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*